US008066829B2

(12) United States Patent
Spehner et al.

(10) Patent No.: US 8,066,829 B2
(45) Date of Patent: Nov. 29, 2011

(54) PROCESS FOR MANUFACTURING STAMPED PRODUCTS, AND STAMPED PRODUCTS PREPARED FROM THE SAME

(75) Inventors: Dominique Spehner, Sedan (FR); Ronald Kefferstein, Saint Mitre les Remparts (FR); Pascal Drillet, Rozerieulles (FR)

(73) Assignee: Arcelormittal France, Saint Denis (FR)

( * ) Notice: Subject to any disclaimer, the term of this patent is extended or adjusted under 35 U.S.C. 154(b) by 0 days.

(21) Appl. No.: 13/118,077

(22) Filed: May 27, 2011

(65) Prior Publication Data

US 2011/0214475 A1 Sep. 8, 2011

Related U.S. Application Data

(63) Continuation of application No. 12/834,162, filed on Jul. 12, 2010, which is a continuation of application No. PCT/IB2008/000079, filed on Jan. 15, 2008.

(51) Int. Cl.
*B32B 15/20* (2006.01)

(52) U.S. Cl. ..... 148/534; 148/531; 148/535; 148/537; 72/364

(58) Field of Classification Search ..... 148/535, 148/534, 537, 531; 72/364
See application file for complete search history.

(56) References Cited

U.S. PATENT DOCUMENTS

| | | | | |
|---|---|---|---|---|
| 4,546,051 | A | 10/1985 | Uchida et al. | |
| 6,017,643 | A | 1/2000 | Kobayashi et al. | |
| 6,093,498 | A | 7/2000 | Baldi | |
| 6,296,805 | B1 | 10/2001 | Laurent et al. | |
| 6,298,905 | B1 | 10/2001 | Kaell et al. | |
| 6,564,604 | B2 | 5/2003 | Kefferstein et al. | |
| 6,815,087 | B2 | 11/2004 | Takagi et al. | |
| 7,137,201 | B2 | 11/2006 | Brodt et al. | |
| 7,867,344 | B2 * | 1/2011 | Kusumi et al. | 148/535 |
| 2001/0042393 | A1 | 11/2001 | Kefferstein et al. | |

(Continued)

FOREIGN PATENT DOCUMENTS

| | | |
|---|---|---|
| EP | 0971044 | 1/2000 |

(Continued)

OTHER PUBLICATIONS

Product Information Manganese-boron steels; Hot press hardening manganese-boron steels MBW for ultrahigh strengths; Updated Sep. 2008; pp. 1-11.

(Continued)

*Primary Examiner* — Jie Yang
(74) *Attorney, Agent, or Firm* — Oblon, Spivak, McClelland, Maier & Neustadt, L.L.P.

(57) ABSTRACT

The invention relates to a process for making a hot stamped coated steel sheet product, comprising the steps of pre-coating a steel strip or sheet with aluminium- or aluminium alloy, cutting said pre-coated steel strip or sheet to obtain a pre-coated steel blank, heating the blank in a furnace preheated to a temperature and during a time defined by diagram according to thickness, at a heating rate $V_c$ between 20 and 700° C. comprised between 4 and 12° C./s and at a heating rate $V_c'$ between 500 and 700° C. comprised between 1.5 and 6° C./s, to obtain a heated blank; then transferring said heated blank to a die, hot stamping the heated blank in the die obtain a hot stamped steel sheet product, cooling at a mean rate $V_r$ between the exit of the heated blank from the furnace, down to 400° C., of at least 30° C./s.

7 Claims, 1 Drawing Sheet

U.S. PATENT DOCUMENTS

| | | | | |
|---|---|---|---|---|
| 2007/0082214 | A1 | 4/2007 | Hultin Stigenberg | |
| 2007/0163685 | A1 | 7/2007 | Kusumi et al. | |
| 2009/0242086 | A1 | 10/2009 | Thomas et al. | |
| 2009/0308499 | A1 | 12/2009 | Scott et al. | |
| 2011/0006491 | A1* | 1/2011 | Spehner et al. | 280/1 |
| 2011/0165436 | A1* | 7/2011 | Drillet et al. | 428/653 |

FOREIGN PATENT DOCUMENTS

| | | |
|---|---|---|
| EP | 1380666 | 1/2004 |
| FR | 1297906 | 5/1962 |
| FR | 2787735 | 6/2000 |
| FR | 2833504 | 6/2003 |
| GB | 1411999 | 10/1971 |
| GB | 1490535 | 11/1977 |
| JP | 62-23975 | 1/1987 |
| JP | 62-130268 | 6/1987 |
| WO | 02/103073 | 12/2002 |
| WO | 2009/090443 | 7/2009 |

OTHER PUBLICATIONS

Taylan Altan, Hot-stamping boron-alloyed steels for automotive parts Part I: Process Methods and Uses; Stamping Journal, Dec. 2006; pp. 40-41.

Taylan Altan, Hot-stamping boron-alloyed steels for automotive parts Part II: Microstructure, material strength changes during hot stamping; Jan. 2007; pp. 14-15.

Arthur B. Shapiro; Using LS-Dyna for Hot Stamping; 7th European LS-DYNA Conference 2009; 9 pages.

International Application No. PCT/IB2009/000322 International Search Report; Apr. 7, 2009.

R. Kolleck, et al, Investigation on induction heating for hot stamping of boron alloyed steels; 2009, pp. 275-278.

Frank Jenner, et al., Evolution of Phases, Microstructure, and Surface Roughness during Heat Treatment of Aluminized Low Carbon Steel; Jun. 2010, vol. 41A; pp. 1554-1563.

X. Bano, et al., Heat Treated Boron Steels In the Automotive Industry; 39$^{th}$ MWSP Conf Proc. ISS, vol. XXXV, 1998; pp. 673-677.

Aruna Bhadur, et al., Structural Studies of Hot Dip Aluminized Coatings on Mild Steel; Materials Transactions, JIM, vol. 32, No. 11 (1991) pp. 1053-1061.

Malek Naderi, et al.; A Numerical and Experimental Investigation Into Hot Stamping of Boron Alloyed Heat Treated Steels; Steel Research Int., 79 (2008), No. 2; pp. 77-84.

Masayoshi Suehiro, et al.; Properties of Aluminum-coated Steels for Hot-forming; Nippon Steel Technical Report 88, Jul. 2003; pp. 16-23.

L. Vaissiere, et al., Development of Pre-Coated Boron Steel for Applications on PSA Peugeot Citroen and Renault Bodies in White, Presented at the International Body of Engineering Conference; Paris Society of Automotive Engineers Jul. 9-11, 2002.

* cited by examiner

PROCESS FOR MANUFACTURING STAMPED PRODUCTS, AND STAMPED PRODUCTS PREPARED FROM THE SAME

This application is a continuation of U.S. Ser. No. 12/834,162 filed Jul. 12, 2010, which claims priority to PCT/IB08/000,079 filed Jan. 15, 2008.

FIELD OF THE INVENTION

The present invention relates to methods of manufacturing hot stamped products prepared from coated steels and to various uses of the invention products such as in spot welding.

BACKGROUND OF THE INVENTION

In recent years the use of coated steels in hot-stamping processes for the shaping of parts has become important, especially in the automotive industry. Fabrication of such parts or products may include the successive following main steps:

- Coating of steel strips or sheets,
- Trimming or cutting for obtaining blanks
- Heating the blanks in order to obtain alloying of the steel substrate with the pre-coating, as well as the austenitizing of the steel
- Hot forming followed by rapid cooling of the part in order to obtain predominantly martensitic structures This is illustrated for example by U.S. Pat. No. 6,296,805, incorporated herein by reference.

Thanks to an alloying of the pre-coating with the steel substrate, which has the effect of creating intermetallic alloys with high melting temperature, the blanks having such coating may be heated in a temperature range where austenitizing of the metallic substrate takes place, allowing further hardening by quenching.

Heat treatments of the blanks in view of the intermetallic alloying of the coating and austenitizing of the substrate are most frequently performed in furnaces. The thermal cycles experienced by the blanks include first a heating phase whose rate is a function of parameters such as furnace temperature settings, travelling speed, blank thickness, heating process, and coating reflectivity. After this heating phase, thermal cycles generally include a holding phase, whose temperature is the regulation temperature of the furnace.

Parts or products obtained after heating, hot stamping and rapid cooling display very high mechanical resistance and may be used for structural applications, for example for automotive industry applications. These parts must be frequently welded with others and high weldability is required. This means that:

- The welding operation should be performable in a sufficiently wide operating range in order to guarantee that an eventual drift of the nominal welding parameters has no incidence on weld quality. For resistance welding, which is very common in the automotive industry, an operating welding range is defined by the combination of parameters: welding current intensity I and force F applied of the parts during welding being among the most important. A proper combination of these parameters helps to ensure that insufficient nugget diameter is not obtained (caused by too low intensity or too low force) and that no weld expulsion occurs.
- The welding operation should also be performed in such a way that high mechanical resistance is obtained in the weld. This mechanical resistance may be evaluated by tests such as by shear-tensile tests or cross-tensile tests.

EP1380666 discloses also a process including hot stamping of Al-coated steel sheets for the fabrication of welded structural members. But the weldability needs to be further improved.

There remains a need for a process making possible to prepare stamped parts or products which are very suitable to spot welding, which are easy to paint and which display good corrosion resistance.

SUMMARY OF THE INVENTION

The inventors have discovered that certain coated steels in which a base steel strip or sheet is at least partially coated (sometimes termed "pre-coated," this prefix indicating that a transformation of the nature of the pre-coating will take place during heat treatment before hot stamping or forming) on at least one side with a coating of either aluminum or an aluminum alloy and in which the coating has a defined thickness, are conveniently formed into shaped parts after heating in particular conditions, and thereby display particular improved weldability.

The inventors have also discovered that particular good weldability of aluminized and hot stamped parts is associated with a special succession of coating layers on the parts, proceeding from steel substrate outwards, and a controlled fraction of porosities in these layers.

The inventors have also discovered that this special disposal of layers is associated to specific heating conditions.

OBJECTS OF THE INVENTION

It is an object of the present invention to provide novel hot stamped parts which are prepared from a pre-coated steel.

It is another object of the present invention to provide novel articles of manufacture, such as a motor vehicle, which contain such stamped parts.

It is another object of the present invention to provide novel methods of making stamped parts displaying high weldability.

These and other objects, which will become apparent during the following detailed description.

DETAILED DESCRIPTION OF THE PREFERRED EMBODIMENTS

Figure 1:
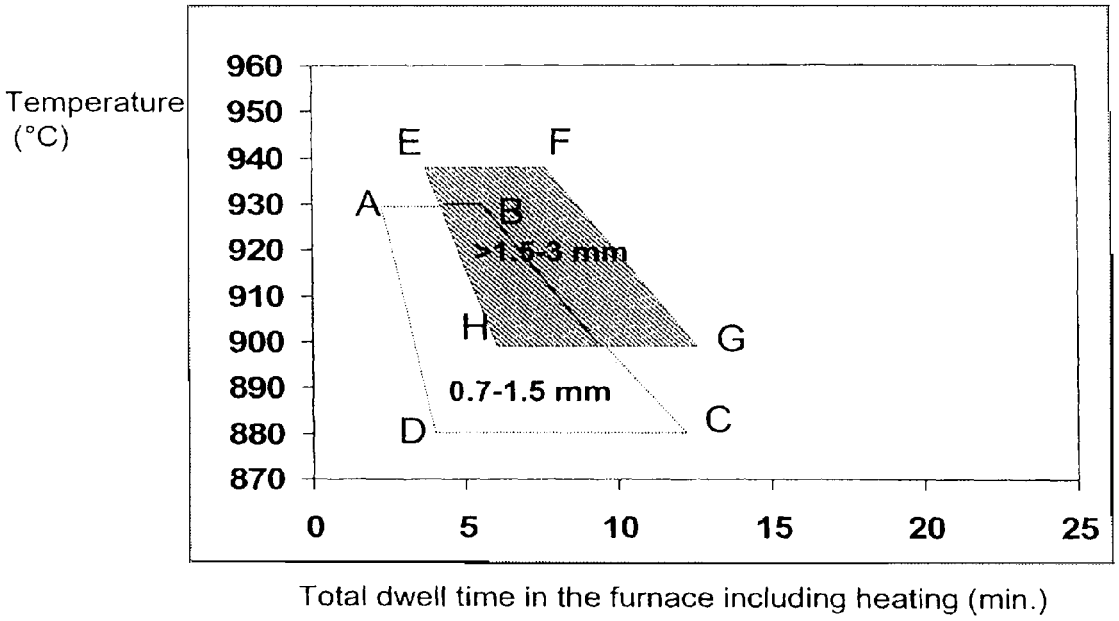
FIG. 1 shows conditions of furnace temperature as a function of the total dwell time in the furnace for sheets of total thicknesses of from 0.7-1.5 mm and 1.5-3 mm that provide particularly favorable coatings for welding.

The invention is implemented with certain pre-coated steel strips, which comprise a strip of base steel and a pre-coating of aluminum or an aluminum alloy on at least a part of one side of the strip of the base steel. For many applications, the strip or sheet of base steel may comprise any type of steel which may be coated with either aluminum or an aluminum alloy. However, for certain applications, such as a structural part of an automobile, it is preferred that the strip of base steel comprises a steel for providing ultra high strength on the part, higher than 1000 MPa. In such cases, it is particularly preferred that the strip of base steel comprises a boron steel.

The strip can derive, by reason of its processing, from a hot-rolling mill, and possibly may be cold-rerolled again depending on the final thickness desired. Preferred thicknesses are 0.7 to 3 mm. Typically, the strip of base steel will be stored and transported in the form of a coil both before and after the formation of the coating.

An example of a preferred steel for the strip of base steel is one having the following composition by weight:

0.10%<carbon<0.5%
0.5%<manganese<3%
0.1%<silicon<1%
0.01%<chromium<1%
nickel<0.1%
copper<0.1%
titanium<0.2%
aluminum<0.1%
phosphorus<0.1%
sulfur<0.05%
0.0005%<boron<0.010%, the remainder comprising, consisting essentially of, or consisting of iron and impurities inherent in processing. Use of such a steel provides a very high mechanical resistance after thermal treatment and the aluminum-based coating provides a high resistance to corrosion.

Particularly preferably, the composition by weight of the steel in the strip of base steel is the following:

0.15%<carbon<0.25%
0.8%<manganese<1.8%
0.1%<silicon<0.35%
0.01%<chromium<0.5%
nickel<0.1%
copper<0.1%
titanium<0.1%
aluminum<0.1%
phosphorus<0.1%
sulfur<0.05%
0.002%<boron<0.005%, the remainder comprising, consisting essentially of, or consisting of iron and impurities inherent in processing.

An example of preferred commercially available steel for use in the strip of base steel is 22MnB5.

Chromium, manganese, boron and carbon may be added, in the composition of the steel according to the invention, for their effect on hardenability. In addition, carbon makes it possible to achieve high mechanical characteristics thanks to its effect on the hardness of the martensite.

Aluminum is introduced into the composition, to perform deoxidation in the liquid state and to protect the effectiveness of the boron.

Titanium, the ratio of the content of which with respect to the nitrogen content should be in excess of 3.42, is introduced for example in order to prevent combining of the boron with the nitrogen, the nitrogen being combined with titanium.

The alloying elements, Mn, Cr, B, make possible a hardenability allowing hardening in the stamping tools or the use of mild hardening fluids limiting deformation of the parts at the time of thermal treatment. In addition, the composition according to the invention is optimized from the point of view of weldability. Additions of Ni and Cu, up to 0.1%, may also be performed.

The steel may undergo a treatment for globularization of sulfides performed with calcium, which has the effect of improving the fatigue resistance of the sheet.

The strip of base steel is coated (or pre-coated, this prefix indicating that a transformation of the nature of the pre-coating will take place during heat treatment before stamping) with either aluminum or an aluminum alloy, preferably with hot-dip. A typical metal bath for an Al—Si coating generally contains in its basic composition by weight, from 8% to 11% silicon, from 2% to 4% iron, the remainder being aluminum or aluminum alloy, and impurities inherent in processing. Silicon is present in order to prevent the formation of a thick iron-metallic intermetallic layer which reduces adherence and formability. Other alloying elements useful with aluminum herein include iron, and calcium, between 15 and 30 ppm by weight, including combinations of two or more thereof with aluminium. Typical composition of Al—Si coating is: Al-9.3% Si-2.8% Fe. Invention coatings are not limited to these compositions, however.

While not bound by a particular theory of operation, the inventors believe that several of the benefits of the invention are first related to a specific range of pre-coating thickness $t_p$ of 20 to 33 micrometers:

For a pre-coating thickness less than 20 micrometers, the alloyed layer which is formed during the heating of the blank has an insufficient roughness. Thus, the adhesion of subsequent painting is low on this surface, and the corrosion resistance is decreased.

If the pre-coating thickness is more than 33 micrometers at a given location on a sheet, the risk is that the difference of thickness between this location and some other locations where the pre-coating is thinner, becomes too important, and that alloying during the heating of the blank becomes uneven. The inventors have also shown that the control of the pre-coating thickness in the narrow range presented above, contributes to form coatings after alliation whose thickness is also controlled in a precise range. This is also a factor for ensuring that the range of resistance welding parameters applied on parts after alliation is not subject to variability.

The pre-coated steel sheets or strips are then cut into blanks, and submitted to heat treatments in furnace prior to hot stamping, in order to obtain products or parts. The inventors have discovered that very good welding properties are achieved if the coating obtained on parts or products made out of blanks having undergone intermetallic alloying, austenitizing and hot stamping, displays distinctive features. It must be pointed out that this coating is different from the initial pre-coating, since the thermal treatment causes an alloying reaction with the steel substrate which modifies both the physico-chemical nature and the geometry of the pre-coating: in this regard, the inventors have discovered that particularly good weldability of aluminized and hot stamped parts is associated with the following succession of coating layers on the parts, proceeding from steel substrate outwards:

(a) Interdiffusion layer,
(b) Intermediate layer,
(c) Intermetallic layer,
(d) Superficial layer The inventors have also discovered that particular good weldability is obtained with a limited quantity of porosities in the coating layers, as will be detailed below.

In a preferred embodiment, the layers are as follows:

(a) Interdiffusion layer, preferably with medium hardness (e.g., HV50 g between 290 and 410, HV50 g designating the hardness measured under a load of 50 grams) In a preferred embodiment this layer has the following composition, by weight: 86-95% Fe, 4-10% Al, 0-5% Si
(b) Intermediate layer (HV50 g around 900-1000 e.g., +/−10%))
In a preferred embodiment this layer has the following composition, by weight: 39-47% Fe, 53-61% Al, 0-2% Si
(c) Intermetallic layer, with hardness HV50 g around 580-650, e.g., +/−10%)
In a preferred embodiment this layer has the following composition, by weight: 62-67% Fe, 30-34% Al, 2-6% Si (d) Superficial layer (HV50 g around 900-1000 e.g., +/−10%))

In a preferred embodiment this layer has the following composition, by weight: 39-47% Fe, 53-61% Al, 0-2% Si In a preferred embodiment the total thickness of layers (a) to (d) is greater than 30 micrometers.

In another preferred embodiment, the thickness of layer (a) is less than 15 micrometers.

The inventors have discovered that high weldability is especially obtained when layers (c) and (d) are essentially continuous; the character of essential continuity of these layers is defined in the following manner: the layers may be fully continuous. But they may be fragmented in some areas due to layer parts coming from lower or upper levels. According to the invention, this fragmentation must be limited, i.e. layers (c) and (d) must occupy at least 90% of their respective level. High weldability is obtained when less than 10% of layer (c) is present at the extreme surface of the part. Without being bound by a theory, it is thought that this particular layer disposal, in particular layer (a) and layers (c) and (d) influence the resistivity of the coating both by their intrinsic characteristics and by the effect of roughness. Thus, current flow, heat generation at the surfaces, and nugget formation in the initial stage of spot welding are affected by this particular arrangement.

This favorable layer disposition is obtained for example when aluminum- or aluminum alloy pre-coated steel sheets, whose thickness range from, e.g., 0.7 to 3 mm, are heated for 3 to 13 minutes (this dwell time includes the heating phase and the holding time) in a furnace without special atmosphere is heated to a temperature of 880 to 940° C. The invention does not require a furnace with a controlled atmosphere. Other conditions leading to such favorable layer dispositions are found in FIG. 1 and below.

Particularly preferred conditions are:

for thicknesses of 0.7-1.5 mm

930° C., from 3 minutes up to 6 minutes;

880° C., from 4 minutes 30 seconds up to 13 minutes for thicknesses of 1.5 to 3 mm 940° C., from 4 minutes up to 8 minutes;

900° C., from 6 minutes 30 seconds up to 13 minutes

For sheets of total thicknesses greater or equal to 0.7 mm, and less than or equal to 1.5 mm, the preferred treatment conditions: (furnace temperature, total dwell time in the furnace) are illustrated in FIG. 1 by conditions lying within the limits of diagram "ABCD"

For sheets of total thicknesses greater than 1.5 mm, and less than or equal to 3 mm, the preferred treatment conditions: (furnace temperature, total dwell time in the furnace) are illustrated in FIG. 1 by diagram "EFGH".

The heating rate $V_c$ is comprised between 4 and 12° C./s for producing a favorable alloyed layer disposition. $V_c$, depending in particular of furnace settings, is defined as the mean heating rate between 20 and 700° C. experienced by the pre-coated steel blank in the preheated furnace. The inventors have discovered that the control of $V_c$ in this particular range allows to influence the nature and the morphology of the alloyed layers which are formed. It is here underlined that the heating rate $V_c$ is different from the mean heating rate, which is the heating rate between room temperature and furnace holding temperature.

The inventors have discovered in a surprising manner that special heating conditions are particularly favourable for the formation of alloyed layers, leading to less porosities formation. Without being bound by a theory of the invention, it is believed that the formation of the preferred alloyed layers takes place in a particular temperature range due to the particular kinetics of alliation in this range: in this respect, it has been discovered that the control of the heating rate in the particular temperature range between 500 and 700° C. (designated here as $V_c'$) is especially important and that the value of $V_c'$ has to be comprised between 1.5 and 6° C./s.

When $V_c'$ is lower than 1.5° C./s, there is a risk that the kinetics of oxidation, resulting from the interaction of oxygen of the furnace atmosphere with the pre-coating surface, competes with the kinetics of alliation between the steel substrate and the pre-coating. Thus, the desired alloyed layer disposal is not obtained. Furthermore slow heating rate $V'_c$ causes a too high quantity of porosities in the coating.

When $V_c'$ is higher than 6° C./s, the intermetallic layer (c) has a tendency to be present in more than 10% at the extreme surface of the part, thus reducing weldability. When $V_c'$ is comprised between 1.5 and 6° C./s, the character of essential continuity of layers (c) and (d) is fully ensured.

Without being bound by a theory, it is thought that the porosity formation and its influence on weldability, may be explained as follows:

Porosities appear mainly during the interdiffusion of pre-coating with the steel substrate, due to the difference of diffusion fluxes. This implies a flux of vacancies with a creation of Kirkendal defects. This manifestation of vacancies under the form of porosities appears to be optimized when heating rate $V'_c$ is comprised between 1.5 and 6° C./s.

During spot welding of welding products, current flows initially around the porosities, which collapse progressively due to pressure and temperature elevation. Thus, the current flows through a coating whose some properties may change discontinuously, which in turn may lead to increased sparking and splashings during the welding operation.

Increased spot weldability is observed when the coating resulting from interdiffusion contains, in surfacic fraction, less than 10% of porosities. For a given area representative of the coating, this fraction is the total surface occupied by porosities, as referred to the area of the coating.

Special good weldability is experienced when the superficial layer has a controlled compacity, which means that the superficial layer (d) contains less than 20% porosities: this fraction is the surface of porosities in the superficial layer (d), as referred to the area of this superficial layer.

A special advantage arises from pre-coatings whose thickness is comprised between 20 and 33 micrometers, since this thickness range yields favorable layer disposal, and since the homogeneity of the pre-coating thickness is associated to an homogeneity of the coating formed after alliation treatment.

Heated blanks are thereafter transferred from the furnace to a die, hot stamped in a press to obtain a part or product, and cooled at a rate $V_r$ of more than 30° C./s. The cooling rate $V_r$ is defined here as the mean rate between the exit of the heated blank from the furnace, down to 400° C. In these conditions, austenite formed at high temperature mainly transform into martensitic or martensitic-bainitic structures with high strength.

In a preferred embodiment, the elapsed time between the exit of the heated blank and the introduction of the blank in the hot stamping press is not more than 10 seconds. Otherwise, a partial transformation from austenite is susceptible to appear: if obtaining a full martensitic structure is desired, the transfer time between the exit of the furnace and stamping should be less than 10 s.

The coating obtained has in particular the function of protecting the basic sheet against corrosion in various conditions. At the time of thermal treatment performed on a finished part or at the time of a hot-shaping process, the coating forms a layer having a substantial resistance to abrasion, wear, fatigue, shock, as well as a good resistance to corrosion and a good capacity for painting and gluing. The coating makes it possible to avoid different surface-preparation operations such as for steel sheets for thermal treatment not having any coating.

The thermal treatment applied at the time of a hot-forming process or after forming makes it possible to obtain high mechanical characteristics which can exceed 1500 MPa for mechanical resistance and 1200 MPa for yield stress. The final mechanical characteristics are adjustable and depend in particular on the martensite fraction of the structure, on the carbon content of the steel and on the thermal treatment.

The invention also concerns the use of a hot-rolled steel sheet which then can be cold-rolled and coated, for structural and/or anti-intrusion or substructure parts for a land motor vehicle, such as, for example, a bumper bar, a door reinforcement, a wheel spoke, etc.

The present invention will now be further described by way a certain exemplary embodiments which are not intended to be limiting.

EXAMPLES i)—Conditions according to the invention: in an example of implementation, a cold rolled steel sheet, 1.2 mm thick, has been fabricated: it contains by weight: 0.23% carbon, 1.25% manganese, 0.017% phosphorus, 0.002% sulfur, 0.27% silicon, 0.062% aluminum, 0.021% copper, 0.019% nickel, 0.208% chromium, 0.005% nitrogen, 0.038% titanium, 0.004% boron, 0.003% calcium. The sheet has been pre-coated with an aluminum-based alloy with composition 9.3% silicon, 2.8% iron, the remainder being aluminum and unavoidable impurities. The thickness on each side of the sheet was controlled to be within the range (20-33) micrometers.

The sheets were afterwards cut into blanks which were heated at 920° C. for 6 mn, this time including the heating phase and the holding time. Heating rate $V_c$ between 20 and 700° C. was 10° C./s. The heating rate $V_c'$ between 500 and 700° C. was 5° C./s. No special control of furnace atmosphere was performed. The blanks were transferred from the furnace to a press in less than 10 s, hot stamped and quenched in order to obtain full martensitic structures.

The parts obtained after hot-stamping are covered by a coating, 40 micrometers thick, which has a four layer structure. Starting from the steel substrate, the layers are the following:

(a) Interdiffusion layer or intermetallic layer, 17 micrometers thick. This layer is itself composed of two sublayers. Hardness HV50 g ranges from 295 to 407, and the mean composition is, by weight: 90% Fe, 7% Al, 3% Si.

(b) Intermediate layer, 8 micrometers thick. This layer has a hardness of 940HV50 g and a mean composition, by weight: 43% Fe, 57% Al, 1% Si.

(c) Intermetallic layer, 8 micrometers thick, displaying a hardness of 610HV50 g, a mean composition of, by weight: 65% Fe, 31% Al, 4% Si (d) Superficial layer, 7 micrometers thick, 950 HV50 g, with a mean composition of, by weight: 45% Fe, 54% Al, 1% Si Layers (c) and (d) are quasi-continuous, i.e. occupying at least 90% of the level corresponding to the considered layer. In particular, layer (c) does not reach the extreme surface except very exceptionally. Anyway, this layer (c) occupies less than 10% of the extreme surface.

A small number of porosities were observed in the coating, their surfacic fraction in this coating being lower than 10%. The surfacic fraction of porosities in the superficial layer (d) is lower than 20%.

ii) Conditions of reference: blanks with the same base material and pre-coating were furnace-heated in different conditions: The blanks were heated to 950° C. for 7 minutes, this time including the heating phase. Heating rate $V_c$ was 11° C./s. Heating rate $V_c'$ between 500 and 700° C. was 7° C./s. These conditions correspond to a degree of alloying which is more important than in conditions (i)

In this coating, the intermetallic layer (c), is not continuous and appears as to be scattered within the coating. About 50% of this layer is present at the extreme surface of the part. The interdiffusion layer, 10 micrometers thick in contact with the steel substrate is thinner than in the previous case. Moreover the porosities are much more numerous than in condition (i) since their surfacic fraction in the coating exceeds 10%. These porosities are especially more numerous in the superficial layer (d) wherein the surfacic fraction exceeds 20%.

Resistance spot welding was performed in the two situations i) and ii):

(i): Coating with quasi-continuous layers (c) and (d), layer (c) occupying less than 10% of the extreme surface, and low surfacic fraction of porosities (ii): Coating with mixed and discontinuous layers, layer (c) occupying more than 10% of the extreme surface, and higher surfacic fraction of porosities Resistance spot welding was performed by superposing two parts and joining them in the following conditions:

Squeeze force and welding force: 4000 N

Squeeze time: 50 periods

Welding and holding time: 18 periods respectively

In each condition, the suitable intensity range was determined for obtaining:

No sputter during welding

Acceptable nugget size.

Tensile tests were also performed to assess the weldability range.

For the condition i), the weldability range, expressed in terms of current intensity, is 1.4 kA. For the condition ii) the weldability range is extremely small. The higher fraction of porosities and the layer disposal are associated to sparks and coating splashing.

Thus, it may be seen that the coating according to the invention, yields much more satisfactory results.

While the above description is clear with regard to the understanding of the invention, the following terms as used in the following list of preferred embodiments and claims have the following noted meanings in order to avoid any confusion:

pre-coating:—the material (Al or Al alloy) coated on or located on at least a portion of the strip or sheet, etc., of base steel to form a pre-coating/base composite, the composite not having been subjected to an alliation reaction between the coated Al or Al alloy material and base steel alliation or alloying:—a reaction between the pre-coating and base steel, to produce at least one intermediate layer different in composition from both the base steel and the pre-coating. The alliation reaction happens during the heat treatment immediately preceding hot stamping. The alliation reaction affects the total thickness of the pre-coating. In a highly preferred embodiment the alliation reaction forms the following layers: (a) interdiffusion, (b) intermediate, (c) intermetallic, and (d) superficial as described above;

pre-coated steel:—the pre-coating/base composite, not having been subjected to an alliation reaction between the coated material and base steel;

coating:—the pre-coating after having been subjected to an alliation reaction between the pre-coating and base steel. In a highly preferred embodiment the coating comprises layers (a) interdiffusion, (b) intermediate, (c) intermetallic, and (d) superficial described above;

coated steel or product:—the pre-coated steel or product that has been subjected to an alliation reaction between the pre-coating and base steel. In a highly preferred embodiment the coated steel is a strip or sheet, etc., of base steel having thereon an invention coating comprising layers (a) interdiffusion, (b) intermediate, (c) intermetallic, and (d) superficial described above;

blank:—a shape cut from a strip.

product:—a hot stamped blank

The above written description of the invention provides a manner and process of making and using it such that any person skilled in this art is enabled to make and use the same, this enablement being provided in particular for the subject matter of the appended claims, which make up a part of the original description.

Thus, the present invention provides, among other things, the following preferred embodiments:

1. A process for making a hot stamped coated steel sheet product, comprising:
   pre-coating a steel strip or sheet with aluminium- or aluminium alloy, then
   cutting said pre-coated steel strip or sheet to obtain a pre-coated steel blank, then
   heating said aluminum- or aluminum alloy pre-coated steel blank in a furnace preheated to a temperature and during a time defined by diagram ABCD of FIG. 1 if thickness of said sheet is greater than or equal to 0.7 mm and less than or equal to 1.5 mm, and by diagram EFGH of FIG. 1 if thickness of said sheet is greater than 1.5 mm and less than or equal to 3 mm, at a heating rate $V_c$ between 20 and 700° C. comprised between 4 and 12° C./s, and at a heating rate $V_c'$ between 500 and 700° C. comprised between 1.5 and 6° C./s, to obtain a heated blank; then
   transferring said heated blank to a die; then
   hot stamping said heated blank in said die, to thereby obtain a hot stamped steel sheet product, then
   cooling said heated product at a mean rate V, between the exit of said heated blank from the furnace, down to 400° C., of at least 30° C./s.

2 A process according to embodiment 1 wherein pre-coating is performed by hot dip of said steel strip or sheet having a first side and a second side, in an aluminium or aluminium alloy bath, the thickness $t_p$ of the said pre-coating being from 20 to 33 micrometers at every location on said first and second sides of said strip or sheet 3 A process according to embodiment 1 or 2, wherein the elapsed time between said heated blank exits said furnace and said stamping commences is not more than 10 seconds 4 A coated steel stamped product, which comprises:
   (a) a strip of base steel having a first side and a second side; and
   (b) a coating on at least one of said first side of said strip of base steel and said second side of said strip of base steel, wherein:
   (i) said coating results from the interdiffusion between said base steel, and aluminium or aluminium alloy pre-coating,
   (ii) said coating comprises, proceeding from base steel outwards,
      (a) Interdiffusion layer
      (b) Intermediate layer
      (c) Intermetallic layer
      (d) Superficial layer
   (iii) said coating contains, in surfacic fraction, less than 10% of porosities 5 A coated steel stamped product according to embodiment 4, wherein said superficial layer (d) contains, in surfacic fraction, less than 20% of porosities 6 A coated steel stamped product according to embodiments 4 or 5, wherein said coating has a thickness greater than 30 micrometers 7 A coated steel stamped product according to any of the embodiments 4 to 6,
   wherein said layer (a) has a thickness less than 15 micrometers 8 A coated steel stamped product according to any of the embodiments 4 to 7, wherein the said layers (c) and (d) are quasi-continuous by occupying at least 90% of their respective level and wherein less than 10% of layer (c) is present at the extreme surface of said product 9 A coated steel stamped product according to any of the embodiments 4 to 8, wherein the steel composition in the strip comprises the following components by weight based on total weight:
   0.15%<carbon<0.5%
   0.5%<manganese<3%
   0.1%<silicon<0.5%
   0.01%<chromium<1%
   nickel<0.1%
   copper<0.1%
   titanium<0.2%
   aluminum<0.1%
   phosphorus<0.1%
   sulfur<0.05%
   0.0005%<boron<0.08%,
   and further comprises iron and impurities inherent in processing.

10 A coated steel stamped product according to any of the embodiments 4 to 8, wherein the steel composition in the strip comprises the following components by weight based on total weight:
   0.20%<carbon<0.5%
   0.8%<manganese<1.5%
   0.1%<silicon<0.35%
   0.01%<chromium<1%
   nickel<0.1%
   copper<0.1%
   titanium<0.1%
   aluminum<0.1%
   phosphorus<0.05%
   sulfur<0.03%
   0.0005%<boron<0.01%,
   and further comprises iron and impurities inherent in processing.

11 A coated steel stamped product according to any of the embodiments 4 to 10, wherein the aluminum or aluminum alloy pre-coating comprises from 8% to 11% silicon by weight, from 2% to 4% iron by weight, the remainder being aluminum and impurities inherent in processing.

12 A land motor vehicle comprising the heat treated coated steel product according to any of the embodiments 4 to 11

13 A land motor vehicle comprising the heat treated coated steel product produced according to any of the embodiments 1 to 3

The invention claimed is:

1. A process for making a hot stamped coated steel product, comprising:

Heating a aluminum or aluminum alloy pre-coated steel blank, a thickness $t_p$ of the pre-coating being form 20 to 33 micrometers, in a furnace preheated to a temperature and time during a time defined by diagram ABCD of FIG. 1 if a thickness of said blank is greater than or equal to 0.7 mm and less than or equal to 1.5 mm, and by diagram EFGH of FIG. 1 if a thickness of said blank is greater than 1.5 mm and less than or equal to 3 mm, at a mean heating rate $V_c$ between 20 and 700° C. of 4-12° C./s, and a mean heating rate $V_c'$ between 500 and 700° C. of 1.5-6° C./s, to obtain a heated blank, wherein the mean heating rate $V_c$ is greater than the mean heating rate $V_c'$; and Hot stamping said heated blank in a die.

2. The process according to claim 1, further comprising:

hot stamping said heated blank in said die, to thereby obtain a hot stamped steel sheet product, and cooling said hot stamped steel sheet product to 400° C. at a mean rate $V_r$ of at least 30° C./s.

3. The process according to claim 2, wherein the pre-coated steel blank is formed by hot dipping a steel strip or sheet having a first side and a second side in an aluminium or aluminium alloy bath to provide a pre-coating having a thickness $t_p$ of the said pre-coating being from 20 to 33 micrometers at every location on said first and second sides of said strip or sheet.

4. The process according to claim 2, wherein an elapsed time between when said heated blank exits said furnace and said stamping commences is not more than 10 seconds.

5. The process according to claim 1, wherein a composition of the steel blank comprises iron and the following components by weight based on total weight:

0.15%<carbon<0.5%
0.5%<manganese<3%
0.1%<silicon<0.5%
0.01%<chromium<1%
nickel<0.1%
copper<0.1%
titanium<0.2%
aluminum<0.1%
phosphorus<0.1%
sulfur<0.05%
0.0005%<boron<0.08%.

6. The process according to claim 1, wherein the composition of the steel blank comprises iron and the following components by weight based on total weight:

0.20%<carbon<0.5%
0.8%<manganese<1.5%
0.1%<silicon<0.35%
0.01%<chromium<1%
nickel<0.1%
copper<0.1%
titanium<0.1%
aluminum<0.1%
phosphorus<0.05%
sulfur<0.03%
0.0005%<boron<0.01%.

7. The process according to claim 1, wherein the composition of the aluminum or aluminum alloy pre-coating comprises aluminum, from 8% to 11% silicon by weight, and from 2% to 4% iron by weight.

* * * * *